US008439343B2

(12) United States Patent
Yamaguchi

(10) Patent No.: US 8,439,343 B2
(45) Date of Patent: May 14, 2013

(54) IMAGE FORMING APPARATUS WITH CASSETTE CONFIGURED TO STORE VARIOUS SIZES OF SHEETS

(75) Inventor: Yoshihiro Yamaguchi, Osaka (JP)

(73) Assignee: Kyocera Mita Corporation (JP)

( * ) Notice: Subject to any disclaimer, the term of this patent is extended or adjusted under 35 U.S.C. 154(b) by 46 days.

(21) Appl. No.: 12/857,593

(22) Filed: Aug. 17, 2010

(65) Prior Publication Data

US 2011/0049798 A1 Mar. 3, 2011

(30) Foreign Application Priority Data

Aug. 26, 2009 (JP) ..... 2009-195380

(51) Int. Cl.
*B65H 3/44* (2006.01)

(52) U.S. Cl.
USPC ..... 271/9.01; 271/162

(58) Field of Classification Search ..... 271/162, 271/145, 9.01, 9.02, 9.11, 9.12, 164, 159, 271/126, 157–158, 171, 148; 399/393
See application file for complete search history.

(56) References Cited

U.S. PATENT DOCUMENTS 5,195,734 A * 3/1993 Tanabe ..... 271/9.03
6,123,329 A * 9/2000 Sato et al. ..... 271/9.01
6,526,253 B2 * 2/2003 Hayashi et al. ..... 271/9.01
6,603,952 B2 * 8/2003 Hoene et al. ..... 399/393
2009/0200728 A1 * 8/2009 Sugiyama ..... 271/9.01

FOREIGN PATENT DOCUMENTS

JP 61-188336 * 8/1986
JP 2625057 4/1997
JP 9-290933 * 11/1997
JP 2002-37468 2/2002

* cited by examiner

*Primary Examiner* — Thomas Morrison
(74) *Attorney, Agent, or Firm* — Gerald E. Hespos; Michael J. Porco; Matthew T. Hespos

(57) ABSTRACT

An image forming apparatus for forming an image on a sheet including: a housing; a cassette detachably accommodated in the housing and configured to store the sheet; a feeding unit configured to feed the sheet; and an image forming unit configured to form the image on the sheet fed by the feeding unit, wherein the cassette includes: a first wall along the trailing edge, a second wall along the leading edge, a first bottom plate extending from the first wall toward the second wall, a second bottom plate extending from the second wall toward the first wall, and a connecting member configured to set a first state where the first and second bottom plates are connected and a second state where the first and second bottom plates are disconnected, and the first and second bottom plates in the second state are independently withdrawable from the housing.

15 Claims, 6 Drawing Sheets

IMAGE FORMING APPARATUS WITH CASSETTE CONFIGURED TO STORE VARIOUS SIZES OF SHEETS

BACKGROUND OF THE INVENTION

1. Field of the Invention

The present invention relates to an image forming apparatus with a switchable cassette configured to selectively store a larger sheet and a smaller sheet.

2. Description of the Related Art

An image forming apparatus such as a copier, a printer, a facsimile machine or a complex machine provided with their functions typically includes sheet storage portions configured to store sheets such as copy sheets. Various sizes of sheets are generally stored in the sheet storage portions. A user selects a desired size of a sheet among the various sizes of the sheets. An image is formed on the selected sheet. A specific image forming apparatus includes two sheet storage portions arranged side by side.

Generally, depending on usage environment of an image forming apparatus, a specific size of sheets is frequently used while other sizes of sheets are less frequently used. It is not preferable in terms of downsizing, weight saving and production cost reduction of the image forming apparatus to provide an exclusive sheet storage portion for little-used sheets.

Another specific image forming apparatus includes a switchable cassette configured to store sheets and a partition plate configured to partition an interior space of the switchable cassette into two spaces. A user may selectively store two different sizes of sheets as needed basis by attaching or detaching the partition plate. As a result, the user may switch more utility sheets or little-used sheets.

The structure configured to selectively divide the interior space of the switchable cassette into the two storage spaces with the partition plate requires for a user to withdraw the entire switchable cassette from a housing of the image forming apparatus for replenishment or exchange of sheets in the switchable cassette. Accordingly, during feeding a sheet from one storage space for image formation, the structure may not allow the user to replenish or exchange sheets in the other storage space. This leads to less efficient image forming operation.

SUMMARY OF THE INVENTION

An object of the present invention is to provide an image forming apparatus with a cassette to effect an efficient image forming operation.

One aspect of the present invention is directed to an image forming apparatus configured to form an image on a sheet with a leading edge and a trailing edge opposite to the leading edge, including: a housing; a cassette detachably accommodated in the housing and configured to store the sheet; a feeding unit configured to feed the sheet so that the leading edge precedes the trailing edge; and an image forming unit configured to form the image on the sheet fed by the feeding unit, wherein the cassette includes: a first wall along the trailing edge, a second wall along the leading edge, a first bottom plate extending from the first wall toward the second wall, a second bottom plate extending from the second wall toward the first wall, and a connecting member configured to set a first state where the first and second bottom plates are connected and a second state where the first and second bottom plates are disconnected, and the first and second bottom plates in the second state are independently withdrawable from the housing.

DETAILED DESCRIPTION OF THE PREFERRED EMBODIMENTS

Hereinafter, one embodiment according to the present invention is described with reference to the accompanying drawings. Direction-indicating terms such as "upper", "lower", "left" and "right" are merely used in the following description for the purpose of clarifying the description and should not be interpreted in any limited manner. A term "sheet" used in the following description means a copy sheet, a tracing paper, a cardboard, an OHP sheet or another sheet on which an image may be formed.

(Structure of Image Forming Apparatus)

Figure 1:
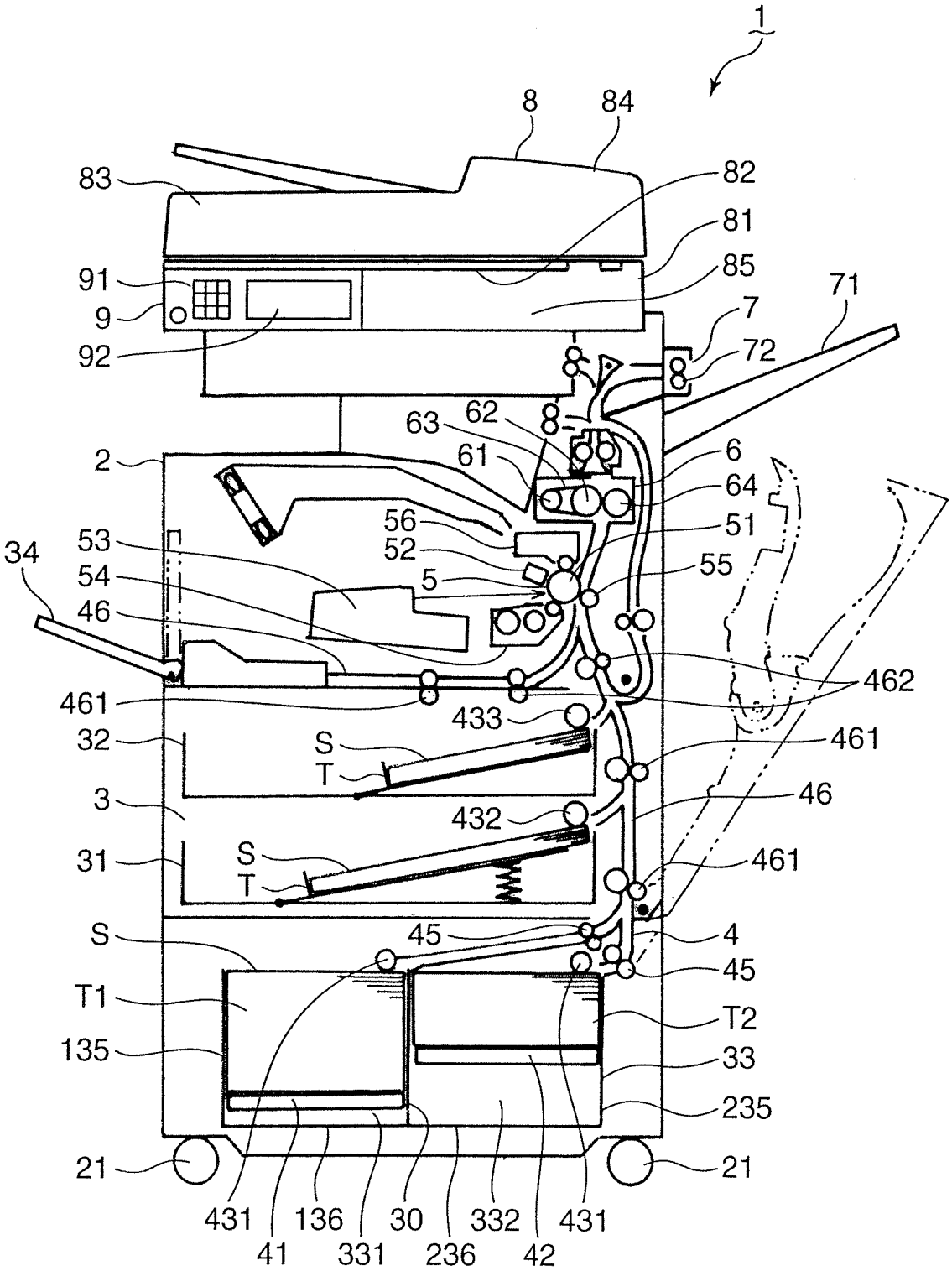
FIG. 1 is a diagram showing a schematic configuration of an image forming apparatus according to one embodiment of the invention.

FIG. 1 mainly shows an internal configuration of an image forming apparatus according to one embodiment of the present invention. The image forming apparatus shown in FIG. 1 is a copier. Alternatively, the image forming apparatus may be a printer, a facsimile machine or a complex machine provided with various functions including an image forming function.

A copier 1 includes a substantially rectangular parallelepiped housing 2 and a storing unit 3 arranged in a lower part of an interior space of the housing 2. Sheets S are stored in the storing unit 3. The copier 1 further includes a feeding unit 4 configured to pick out and feed the sheet S from the storing unit 3, an image forming unit 5 configured to form a toner image on a surface of the sheet S fed by the feeding unit 4, a fixing unit 6 configured to fix the toner image to the surface of the sheet S and a discharging unit 7 configured to discharge the sheet S with the toner image fixed thereto outside the housing 2. A user may easily place the entire copier 1 at a desired position because of casters 21 mounted on the bottom surface of the housing 2. An image reading unit 8 configured to read an image on a document is arranged above the housing 2. The image reading unit 8 reads and converts the image of the document into electronic data. An operation unit 9 between the housing 2 and the image reading unit 8 is exposed at a front side of the copier 1.

The storing unit 3 includes a first cassette 31 and a second cassette 32 above the first cassette 31 which are configured to store a sheet stack T including a fewer sheets S. The storing unit 3 further includes a switchable cassette below the first cassette 31. The switchable cassette 33 may be configured to store a sheet stack T including greater sheets S than those storable in the first or second cassette 31 or 32. The switchable cassette 33 is configured to selectively store different sheets in size. In this embodiment, the switchable cassette 33 is exemplified as a cassette to be detachably accommodated in the housing 2.

The switchable cassette 33 detachably accommodated in the housing 2 is withdrawable from the housing 2 toward the front side of the copier 1. In this embodiment, a withdrawal direction of the switchable cassette 33 from the housing 2 is exemplified as a first direction. The switchable cassette 33 shown in FIG. 1 stores a first small sheet stack T1 and a second small sheet stack T2 in which sheets in smaller size (small sheets) are stacked, respectively. The feeding unit 4 picks out the sheet S one by one from the first or second small sheet stack T1 or T2 in the switchable cassette 33 to feeds it to the right. In the following description, the small sheet stack located at an upstream side in a feeding direction of the sheet S to be picked out and fed by the feeding unit 4 is called a first small sheet stack T1. The small sheet stack located at a downstream side is called a second small sheet stack T2. The withdrawal direction of the switchable cassette 33 is substantially orthogonal to the sheet feeding direction from the first or second small sheet stack T1 or T2.

(Structure of Switchable Cassette)

Figure 2:
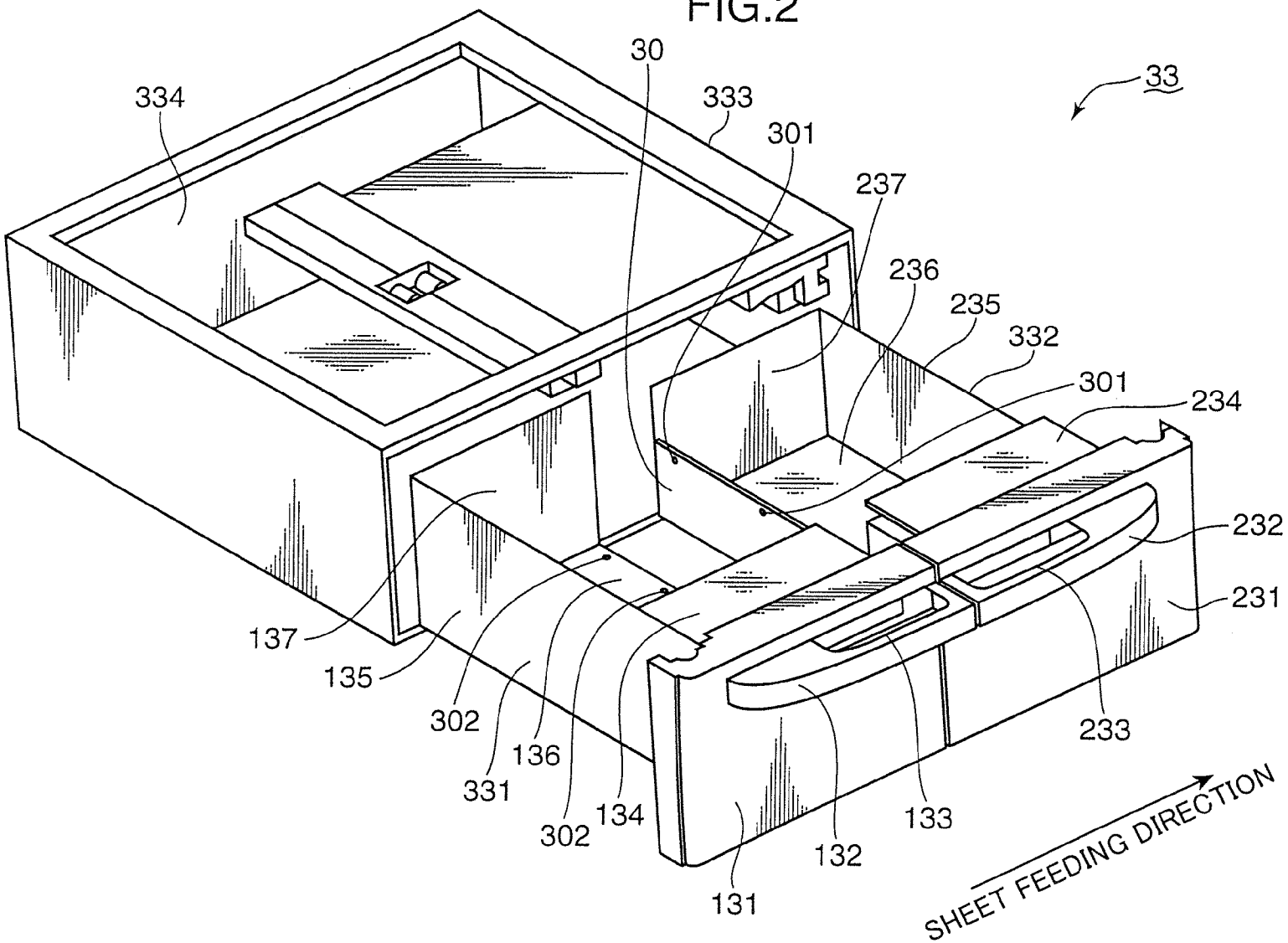
FIG. 2 is a perspective view of a tray of a switchable cassette of the image forming apparatus shown in FIG. 1.

FIG. 2 is a perspective view of the switchable cassette 33. The switchable cassette 33 is described with reference to FIGS. 1 and 2.

The switchable cassette 33 includes an upstream cassette 331 configured to store the first small sheet stack T1, a downstream cassette 332 configured to store the second small sheet stack T2 and a substantially rectangular parallelepiped frame body 333 configured to accommodate the upstream and downstream cassettes 331, 332. It should be note that the frame body 333 is fixedly attached to the housing 2.

The upstream cassette 331 includes a substantially rectangular front plate 131. The front plate 131 exposed from the housing 2 partially forms an outer surface of the copier 1. The front plate 131 includes a grip 132 formed along an upper edge of the front plate 131. A substantially rectangular opening 133 vertically extending is defined in the grip 132. A user holding the grip 132 by inserting his fingers into the opening 133 may pull it toward the front side of the copier 1 to withdraw the upstream cassette 331 from the frame body 333.

A lever (not shown) configured to unlock the upstream cassette 331 accommodated in the frame body 333 may be, for example, attached to the grip 132. A substantially rectangular parallelepiped box portion 134 is arranged adjacent to an inner surface of the front plate 131. A locking mechanism configured to lock the upstream cassette 331 in the frame body 333 may be, for example, arranged in the box portion 134. Further, an elevation mechanism configured to operate a lift plate (see FIG. 1) for supporting and lifting the small sheet stack T1 in the switchable cassette 33 may be, for example, arranged in the box portion 134.

The downstream cassette 332 includes a substantially rectangular front plate 231. The front plate 231 exposed from the housing 2 partially forms the outer surface of the copier 1. The front plate 231 includes a grip 232 formed along an upper edge of the front plate 231. A substantially rectangular opening 233 vertically extending is defined in the grip 232. The user holding the grip 232 by inserting his fingers into the opening 233 may pull it toward the front side of the copier 1 to withdraw the downstream cassette 332 from the frame body 333.

A lever (not shown) configured to unlock the downstream cassette 332 accommodated in the frame body 333 may be, for example, attached to the grip 232. A substantially rectangular parallelepiped box portion 234 is arranged adjacent to an inner surface of the front plate 231. A locking mechanism configured to lock the downstream cassette 332 in the frame body 333 may be, for example, arranged in the box portion 234. Further, an elevation mechanism configured to operate a lift plate (see FIG. 1) for supporting and lifting the small sheet stack T2 in the switchable cassette 33 may be, for example, arranged in the box portion 234.

A substantially rectangular plate-like first wall 135 extends from the inner surface of the front plate 131 of the upstream cassette 331 toward a rear surface of the housing 2. A substantially rectangular plate-like second wall 235 extends from the inner surface of the front plate 231 of the downstream cassette 332 toward the rear surface of the housing 2. The upstream cassette 331 includes a substantially rectangular first bottom plate 136 extending from a bottom edge of the first wall 135 toward the second wall 235. The downstream cassette 332 includes a substantially rectangular second bottom plate 236 extending from a bottom edge of the second wall 235 toward the first wall 135. The first bottom plate 136 is aligned with the second bottom plate 236 in the sheet feeding direction. Withdrawal directions of the first and second bottom plates 136, 236 from the housing 2 are substantially parallel to each other.

The upstream cassette 331 further includes a substantially rectangular plate-like rear wall 137 connecting to not only a vertical rear edge of the first wall 135 but also a rear edge of the first bottom plate 136 extending substantially parallel to the feeding direction of the sheet S. The downstream cassette 332 further includes a substantially rectangular plate-like rear wall 237 connecting to not only a vertical rear edge of the second wall 235 but also a rear edge of the second bottom plate 236 extending substantially parallel to the feeding direction of sheet S.

The rear wall 137 extending from the first wall 135 toward the downstream cassette 332 and the rear surface of the box portion 134 are exemplified as a first peripheral wall standing up from the first bottom plate 136. The rear wall 137 and the rear surface of the box portion 134 define a storage space for storing the first small sheet stack T1 in cooperation with the first wall 135 and the first bottom plate 136. The rear wall 237 extending from the second wall 235 toward the upstream cassette 331 and the rear surface of the box portion 234 are exemplified as a second peripheral wall standing up from the second bottom plate 236. The rear wall 237 and the rear surface of the box portion 234 define a storage space for storing the second small sheet stack T2 in cooperation with the second wall 235 and the second bottom plate 236. The storage space for storing the small sheet stack T1 or T2 is exemplified as a second storage space in this embodiment.

The downstream cassette 332 further includes an intermediate wall 30. The intermediate wall 30 extending along an inner edge of the second bottom plate 236 facing the first bottom plate 136 stands up in a stacking direction of the second small sheet stack T2. The intermediate wall 30 separates the storage space for storing the small sheet stack T1 from the storage space for storing the small sheet stack T2. A rotary shaft (not shown) used for connection with the second bottom plate 236 is arranged at a lower edge of the intermediate wall 30, which is rotatable with respect to the second bottom plate 236.

Figure 3:
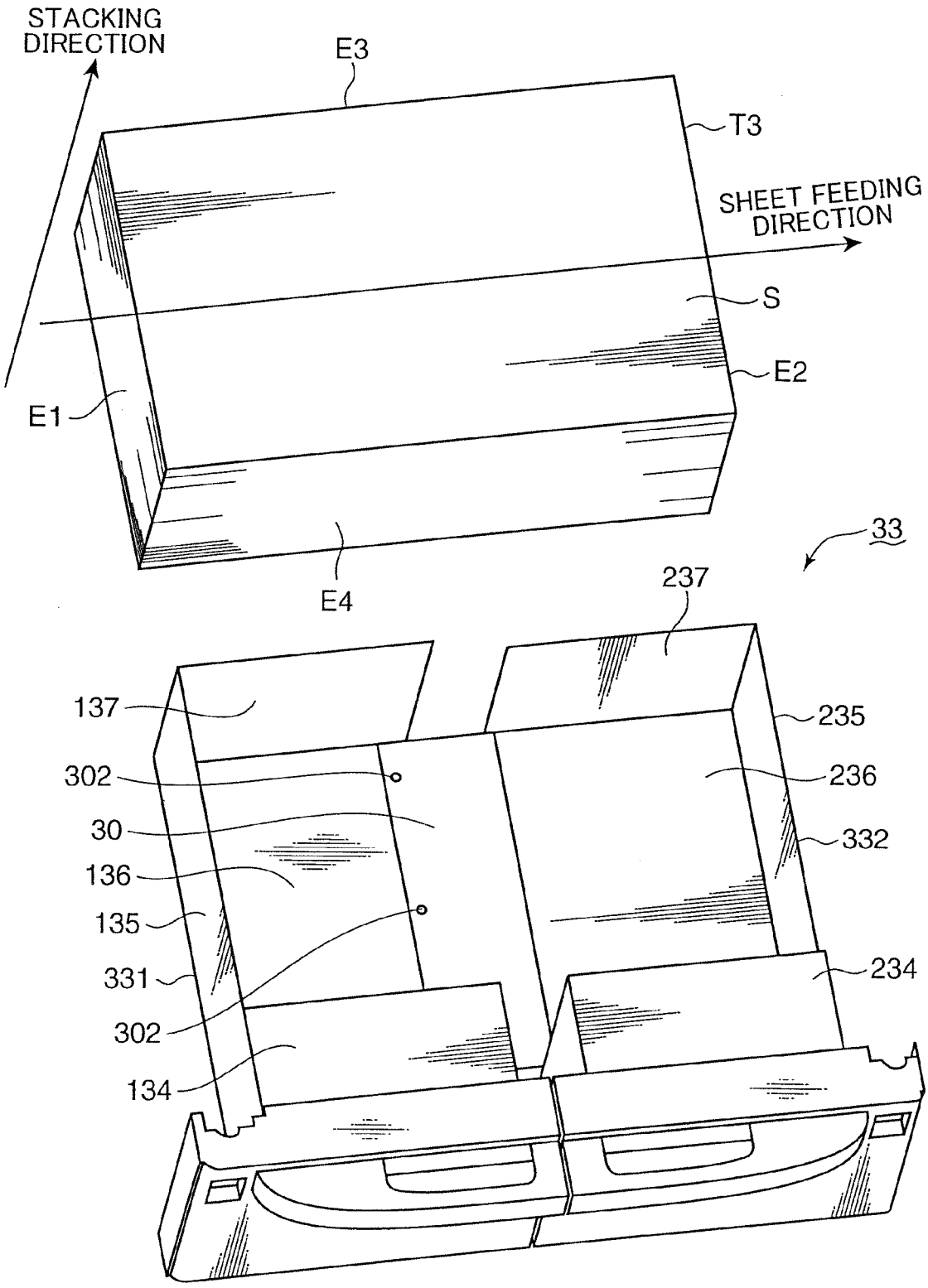
FIG. 3 is a perspective view showing a rotational movement of an intermediate wall of the switchable cassette shown in FIG. 2.

FIG. 3 shows the upstream cassette 331 and the downstream cassette 332 connected with each other and a sheet stack T3 to be stored in the connected upstream cassette 331 and downstream cassette 332. The switchable cassette 33 is further described with reference to FIGS. 1 to 3.

The intermediate wall 30 attached to the second bottom plate 236 is rotated between a first position (see FIG. 3) and a second position (see FIG. 2). The intermediate wall 30 at the first position extending along the first and second bottom plates 136, 236 forms one bottom surface together with the first and second bottom plates 136, 236. As a result, the intermediate wall 30 at the first position defines a storage space for storing the sheet stack T3 in cooperation with the first wall 135, the second wall 235 and the first and second bottom plates 136, 236. The storage space for storing the sheet stack T3 is exemplified as a first storage space in this embodiment.

The intermediate wall 30 at the second position extends in a stacking direction of the sheets S. The intermediate wall 30 is formed with a pair of through holes 301 near an edge opposite to a connecting edge with the second bottom plate 236. A pair of projections 302 complementary to the through holes 31 are formed near an inner edge of the first bottom plate 136 facing the second bottom plate 236. When the intermediate wall 30 moves to the first position, the projections 302 formed on the first bottom plate 136 are inserted into the through holes 301. As a result, the intermediate wall 30 is connected with the first bottom plate 136. In this way, the upstream cassette 331 and the downstream cassette 332 are connected.

When the intermediate wall 30 shown in FIG. 3 is rotated upward to the second position, the first and second bottom plates 136, 236 are disconnected. Preferably, a structure for selectively connecting the box portion 234 and/or the rear wall 237 and the intermediate wall 30 is adopted to keep the intermediate wall 30 at the second position. For example, a projection may be formed on a surface of the box portion 234 facing the box portion 134 of the upstream cassette 331. A through hole complementary to the projection of the box portion 234 may be formed near an edge of the intermediate wall 30 at the second position adjacent to the box portion 234. The intermediate wall 30 is fixed at the second position by engagement between the projection and the through hole. The intermediate wall 30 fixed at the second position partitions the storage space for storing the sheet stack T3 into the storage spaces for storing the small sheet stack T1 and the small sheet stack T2, respectively.

In this embodiment, the rotatable intermediate wall 30 is used as a connecting member configured to selectively set a first state where the first bottom plate 136 and the second bottom plate 236 are connected (see FIG. 3) and a second state where the first and second bottom plates 136, 236 are disconnected (see FIG. 2). Alternatively, another structure configured to selectively connect the first and second bottom plates 136, 236 may be used as the connecting member. The intermediate wall 30 described with reference to FIGS. 1 to 3 is rotatably connected with the second bottom plate 236. Alternatively, the intermediate wall 30 may be rotatably connected with the first bottom plate 136.

While the intermediate wall 30 is arranged at the first position, the switchable cassette 33 may store the sheet stack T3 in which sheets S larger than the sheets S constituting the first and second small sheet stacks T1, T2 are stacked. In this embodiment, the smaller sheets S constituting the first small sheet stack T1 and/or the second small sheet stack T2 are exemplified as second sheets. The larger sheets S constituting the sheet stack T3 are exemplified as first sheets. In this embodiment, when the smaller sheets S are, for example, A4-sheets, the larger sheets S may be A3-sheets.

The sheet S includes a leading edge E2 and a trailing edge E1 opposite to the leading edge E2. The feeding unit 4 described in the context of FIG. 1 feeds the sheet S so that the leading edge E2 precedes the trailing edge E1. Advantageously the sheet stack T3 is less likely to collapse toward an upstream side in the feeding direction because the first wall 135 along the trailing edge E1 of the sheet S extends in the stacking direction of the sheets S. The sheet stack T3 is advantageously less likely to collapse toward a downstream side in the feeding direction because the second wall 235 along the leading edge E2 of the sheet S extends in the stacking direction of the sheets S.

The sheet S also includes a rear edge E3 and a front edge E4 extending between the leading edge E2 and the trailing edge E1. The rear edge E3 is located at a rear side of the copier 1. The front edge E4 is located at the front side of the copier 1. The rear and front edges E3, E4 of the sheet S are exemplified as a side edge extending between the leading and trailing edges E2, E1 of the sheet S. The rear wall 137 standing up from the rear edge of the first bottom plate 136 and the rear wall 237 standing up from the rear edge of the second bottom plate 236 are aligned with each other along the rear edges E3. Thus, the rear walls 137, 237 are likely to prevent the sheet stack T3 from collapsing backward. Similarly, the rear surfaces of the box portions 134, 234 of the upstream cassette 331 and the downstream cassette 332 are aligned with each other along the front edges E4. Thus, the rear surfaces of the box portions 134, 234 are likely to prevent the sheet stack T3 from collapsing forward.

Figure 4:
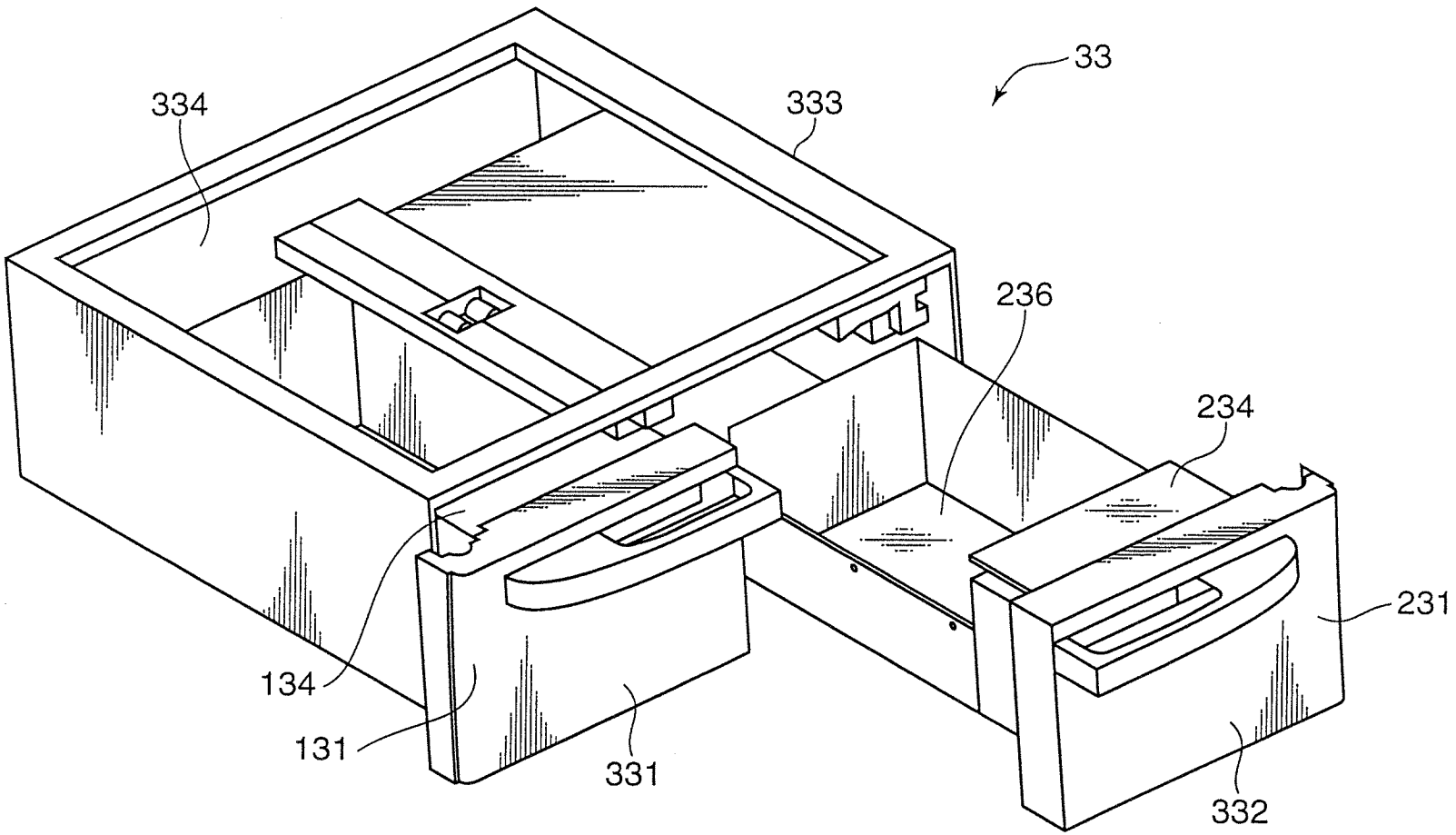
FIG. 4 is a perspective view showing withdrawal operation of the switchable cassette shown in FIG. 2.
Figure 5:
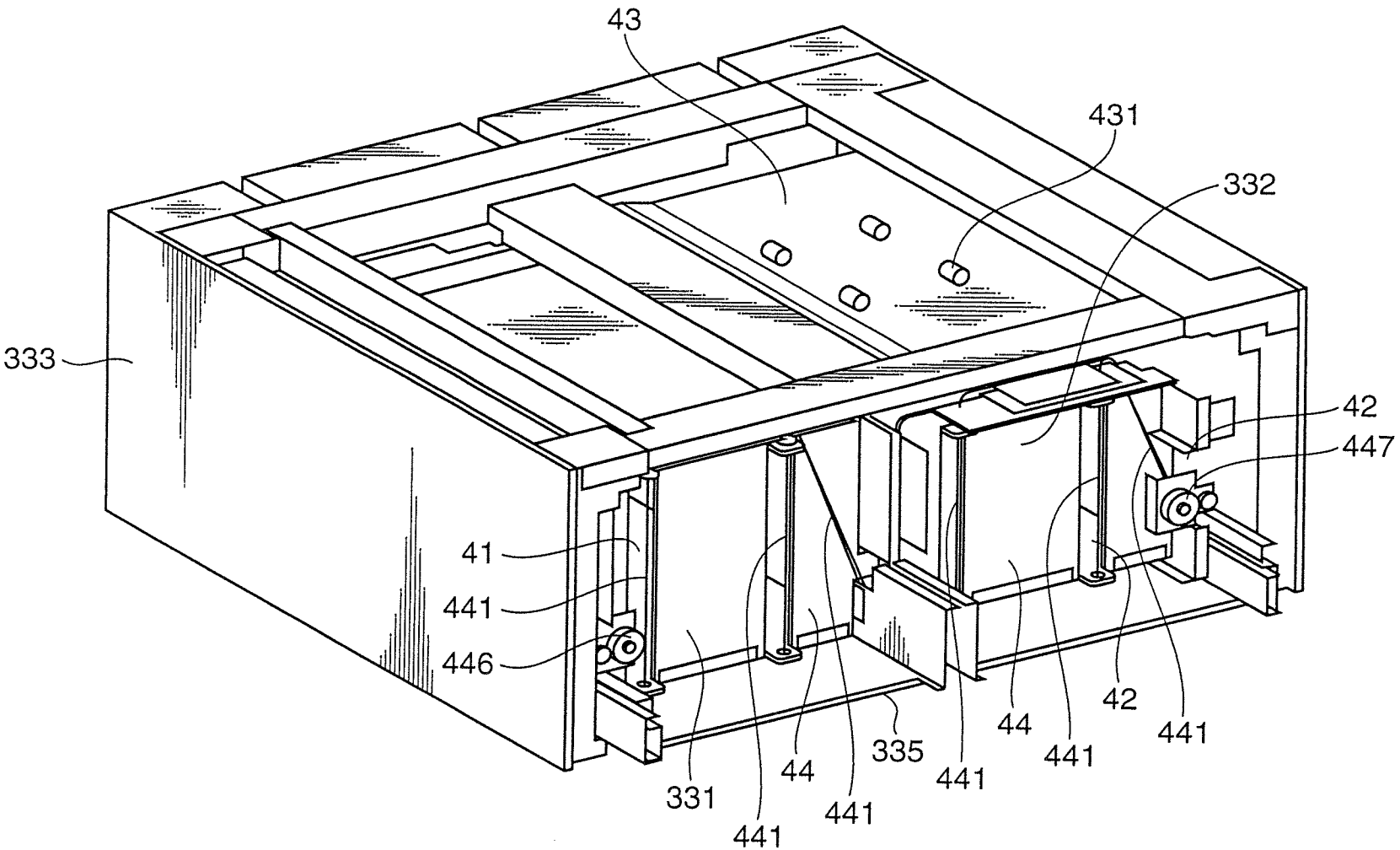
FIG. 5 is a perspective view schematically showing accommodation and an internal configuration of the switchable cassette shown in FIG. 2.

FIG. 4 is a perspective view showing the downstream cassette 332 withdrawn from the frame body 333 independently of the upstream cassette 331. FIG. 5 is a perspective view showing the upstream cassette 331 and the downstream cassette 332 accommodated in the frame body 333. The front plate 131 and the box portion 134 of the upstream cassette 331 shown in FIG. 2 are removed from the upstream cassette 331 shown in FIG. 5 so that an internal structure of the box portion 134 is schematically shown. The front plate 231 and the box portion 234 of the downstream cassette 331 shown in FIG. 2 are removed from the downstream cassette 332 shown in FIG. 5 so that an internal structure of the box portion 234 is schematically shown. The switchable cassette 33 is further described with reference to FIGS. 1 to 5.

When the intermediate wall 30 is arranged at the second position, the user may withdraw only the upstream cassette 331 or the downstream cassette 332 from the frame body 333. If necessary, the user may withdraw both the upstream cassette 331 and the downstream cassette 332 as shown in FIG. 2. It should be noted that the withdrawal directions of the upstream cassette 331 and the downstream cassette 332 are substantially parallel to each other.

A rectangular opening 334 is defined in an upper surface of the frame body 333. A sheet feeder 43 constituting the feeding unit 4 is mounted in the opening 334 of the frame body 333. The sheet feeder 43 above the upstream cassette 331 and the downstream cassette 332 accommodated in the frame body 333 feeds the sheet S from the switchable cassette 33.

(Sheet Feed from Switchable Cassette)

The feed of the sheet S from the switchable cassette 33 is described with reference to FIGS. 1, 4 and 5.

The sheet feeder 43 includes pickup rollers 431. The pickup rollers 431 are mounted above the upstream cassette 331 and the downstream cassette 332, respectively. The feeding unit 4 includes the lift plate 41 disposed in the upstream cassette 331 and the lift plate 42 disposed in the downstream cassette 332. The lift plates 41, 42 vertically move between the first bottom plate 136/second bottom plate 236 and the pickup rollers 431.

Figure 6A:
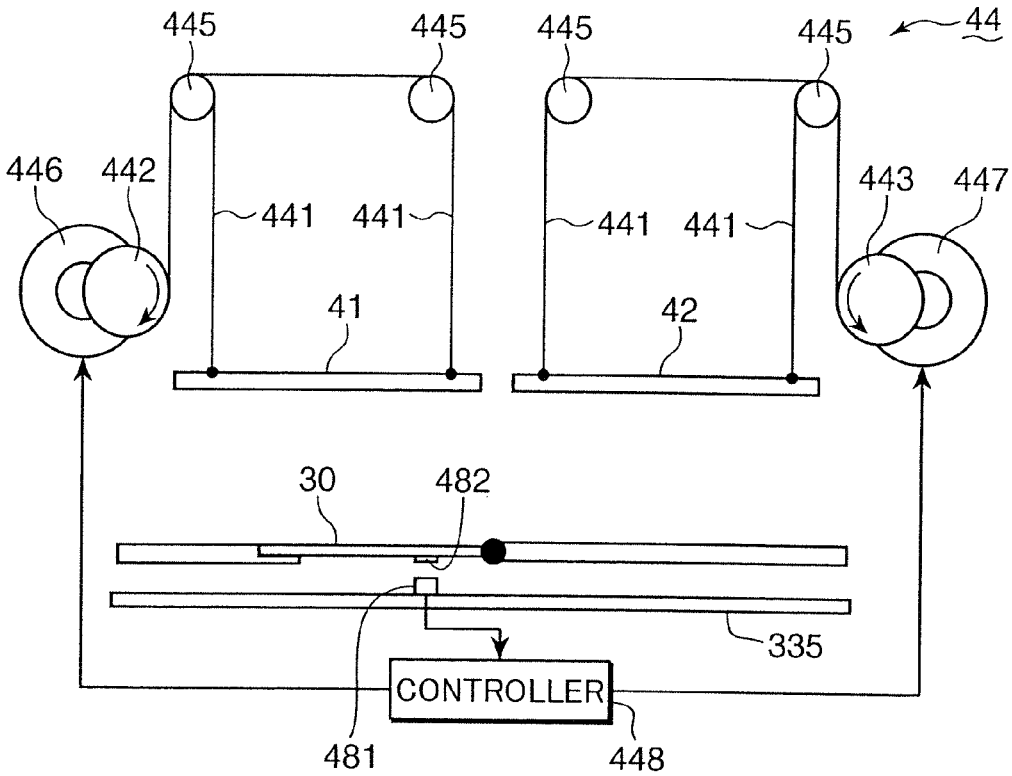
FIGS. 6A and 6B are diagrams showing an elevating mechanism for lift plates in the switchable cassette shown in FIG. 1.
Figure 6B:
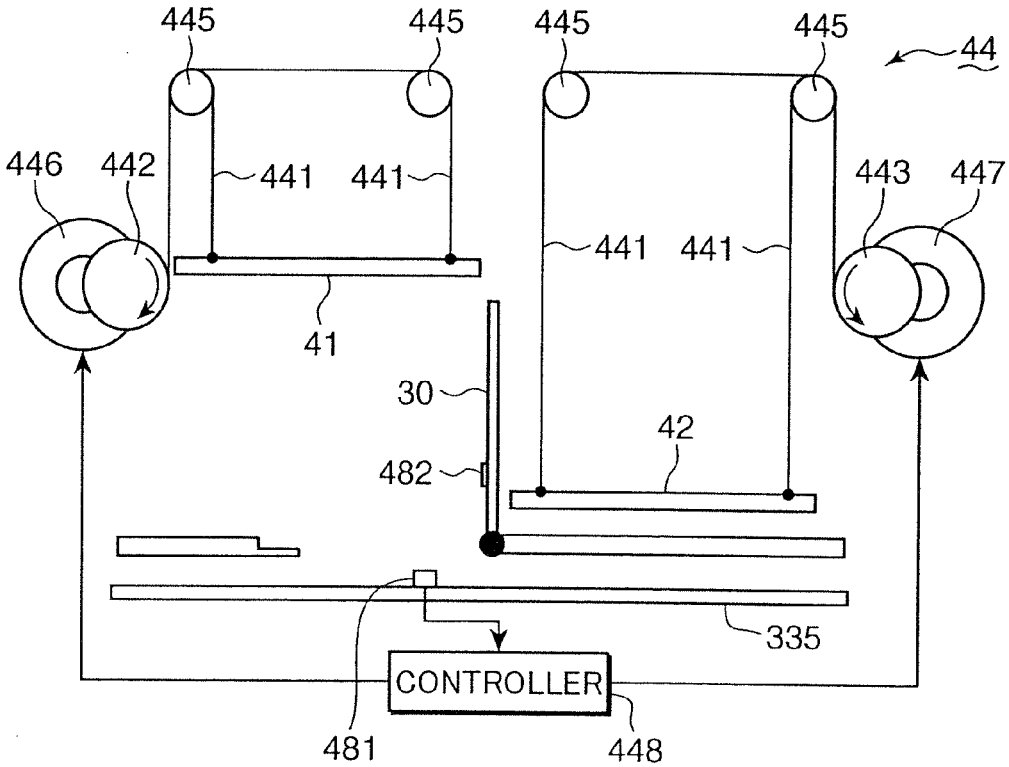

FIGS. 6A and 6B are conceptual diagrams of an elevating mechanism configured to move the lift plates 41, 42. The elevating mechanism is described with reference to FIGS. 1, 4, 6A and 6B.

FIG. 6A shows the intermediate wall 30 at the first position together with the elevating mechanism. FIG. 6B shows the intermediate wall 30 at the second position together with the elevating mechanism. The elevating mechanism shown in FIGS. 6A and 6B is merely an example, and so any mechanism configured to vertically move the lift plates 41, 42 may be used as the elevating mechanism.

The elevating mechanism 44 includes wires 441. The wire 441 includes a first end connected with the lift plate 41 or 42 and a second end wound around a first or second reel 442 or 443. In addition to the wires 441, the first reel 442 and the second reel 443, the elevating mechanism 44 further includes pulleys 445 disposed in paths of the wires 441 connecting the lift plate 41 with the first reel 442 and paths of the wires 441 connecting the lift plate 42 with the second reel 443.

The first and second reels 442, 443 are connected to drive sources 446, 447 (e.g. motors), respectively. When the first reel 442 and/or the second reel 443 are/is rotated in directions shown by arrows in FIGS. 6A and 6B, the wires 441 are wound around the first reel 442 and/or the second reel 443 to raise the lift plates 41, 42. When the sheet stack T3 or the sheet stack T1, T2 is placed on the lift plates 41, 42, the lift plates 41, 42 may move downward due to weight of the sheet stack T3 or the sheet stack T1, T2. Optionally, the elevating mechanism 44 may include sensors configured to control height positions of the lift plates 41, 42. The elevating mechanism 44 raises the lift plates 41, 42 to carry the sheet stack T3 or the sheet stack T1, T2 on the lift plates 41, 42 to the pickup roller 431.

The elevating mechanism 44 further includes a controller 448 configured to output control signals for controlling the drive sources 446, 447, which operate based on the control signals. The controller 448 may control the entire copier 1.

A reflective optical sensor 481 is mounted on a bottom plate 335 of the frame body 333. In this embodiment, the reflective optical sensor 481 is exemplified as a sensor configured to detect a position of the intermediate wall 30. A reflector 482 is mounted on the intermediate wall 30. The reflector 482 mounted on the intermediate wall 30 at the first position reflects a beam irradiated from the reflective optical sensor 481 to return the reflected light to the reflective optical sensor 481. The reflective optical sensor 481 then outputs a first signal indicating reception of the reflected light to the controller 448. When the intermediate wall 30 is at the second position, the beam irradiated from the reflective optical sensor 481 does not reach the reflector 482, so that the reflective optical sensor 481 receives no reflected light. The reflective optical sensor 481 then outputs to the controller 448 a second signal indicating no reception of the reflected light.

The controller 448 after receiving the second signal, for example, controls the drive sources 446, 447 so that one of the lift plates 41, 42 moves upward. The controller 448 after receiving the first signal, for example, substantially levels the lift plates 41, 42. Thereafter, the controller 448 controls the drive sources 446, 447 to move the lift plates 41, 42 upward with keeping the leveled relationship between them.

In this embodiment, the reflective optical sensor 481 is used as a sensor configured to detect the intermediate wall 30 arranged at the first position and/or the second position. Alternatively, another sensor configured to detect the position of the intermediate wall 30 may be used instead of the reflective optical sensor 481.

In this embodiment, the controller 448 identifies based on a detection signal from the reflective optical sensor 481 whether the small sheet stacks T1, T2 as stacks of the smaller sheets S are stored in the switchable cassette 33 or the sheet stack T3 as a stack of the larger sheets S is stored in the switchable cassette 33. The controller 448 further controls movements of the lift plates 41, 42 based on the identification result. Alternatively or additionally, the controller 448 may perform another necessary control for the feeding unit 4 to feed the sheet S from one of the small sheet stacks T1, T2 and another necessary control for the feeding unit 4 to feed the sheet S from the sheet stack T3.

In FIGS. 6A and 6B, the lift plate 41 goes up so that the intermediate wall 30 is less likely to interfere with the lift plate 41. Alternatively, any other approaches may be employed to avoid the interference between the intermediate wall 30 and the lift plate 41. For example, a cutout or a recess for avoiding the interference between the lift plate 41 and the intermediate wall 30 may be defined in the lift plate 41.

The controller 448 may be, for example, a control circuit of the operation unit 9. The operation unit 9 may receive operational inputs on the image forming process by the user. The operation unit 9 may include, for example, a numerical pad used to input a number of sheets S to be processed, operation keys 91 used to designate various other operations and a LCD (Liquid Crystal Display) touch panel 92 in a touch-input manner.

The operation unit 9 may receive inputs on types of sheets (e.g. types such as ordinary sheets, cardboards, OHP sheets (over head projector sheets) and tracing papers) stored in the upstream cassette 331, the downstream cassette 332, the first cassette 31 and the second cassette 32. Optionally, the operation unit 9 may also receive an input on the type of sheet(s) placed on a manual feed tray 34 rotatably mounted on an outer surface of the housing 2 above the second cassette 32.

The operation unit 9 may also receive an input used to designate a source of feeding a sheet S on which an image is to be formed. The user may designate any one of the first cassette 31, the second cassette 32 and the switchable cassette 33 as the source of feeding a sheet S. If the controller 448 identifies, based on the output signal from the reflective optical sensor 481, that the intermediate wall 30 is located at the second position, the controller 448 causes the touch panel to display a menu screen through which a user may select one of the upstream cassette 331 and the downstream cassette 332 as the sheet feeding source. The user may designate one of the upstream cassette 331 and the downstream cassette 332 as the sheet feeding source. When the user designates the upstream cassette 331, the controller 448 executes a control to raise only the lift plate 41 in the upstream cassette 331. When the user designates the downstream cassette 332, the controller 448 executes a control to raise only the lift plate 42 in the downstream cassette 332. When the controller 448 figures out, based on the output signal of the reflective optical sensor 481, that the intermediate wall 30 is located at the first position and if the user designates the switchable cassette 33 as the sheet feeding source, the controller 448 executes a control to raise both the lift plates 41, 42.

When the lift plates 41, 42 move upward and the sheet S comes into contact with the pickup rollers 431, the sheet in the switchable cassette 33 is fed to the right by the pickup rollers 431 (see FIG. 1). The feeding unit 4 includes separation/feed rollers 45 disposed at a downstream side of the pickup rollers 431. The separation/feed rollers 45 feed the sheets S fed from the switchable cassette 33 one by one to a downstream conveyance path 46. Pickup rollers 432, 433 above the first and second cassettes 31, 32 feed the sheets S to the conveyance path 46 from the first and second cassettes 31, 32, respectively.

(Process Performed for Sheet Fed from Switchable Cassette)

With reference to FIG. 1 again, a process performed for the sheet S fed from the switchable cassette 33 (or first cassette 31 or second cassette 32) is described.

The conveyance path 46 extends upward along a right surface of the housing 2. Conveyor roller pairs 461 at intermediate positions of the conveyance path 46 convey the sheet S downstream. A conveyor roller pair 461 is also disposed at an intermediate position of the conveyance path 46 extending from the manual feed tray 34. The conveyance path 46 extends toward the image forming unit 5 to guide the sheet S there. A registration roller pair 462 immediately before the image forming unit 5 feeds the sheet S to the image forming unit 5 in synchronization with an image forming timing in the image forming unit 5.

The image reading unit 8 built in an upper housing 81 above the housing 2 includes a contact glass 82 mounted in an opening defined in an upper surface of the upper housing 81. A desired document is placed on the contact glass 82. The image reading unit 8 further includes a cover member 83. The cover member 83 rotatably mounted on the upper housing 81 is configured to press the document on the contact glass 82. The cover member 83 includes an automatic document feeder 84 configured to automatically feed the desired document onto the contact glass 82. The image reading unit 8 further includes a scanning mechanism 85 configured to read the document on the contact glass 82 as analog information and convert the analog information into a digital signal.

The image forming unit 5 includes a substantially cylindrical photoconductive drum 51 rotatably mounted in the housing 2 and a charger unit 52 adjacent to the photoconductive drum 51. The charger unit 52 uniformly charges a circumferential surface of the photoconductive drum 51. The image forming unit 5 further includes an exposure unit 53 configured to irradiate a laser beam to the circumferential surface of the photoconductive drum 51 uniformly charged by the charger unit 52. An irradiation position of the laser beam is controlled based on the digital signal generated by the image reading unit 8. The laser beam causes electric charges on the circumferential surface of the photoconductive drum 51 to disappear. As a result, an electrostatic latent image is formed on the circumferential surface of the photoconductive drum 51.

The image forming unit 5 further includes a developing unit 54 configured to supply toner to the circumferential surface of the photoconductive drum 51 with the electrostatic latent image formed thereon. By the toner supply from the developing unit 54, a toner image coincident with the electrostatic latent image is formed on the circumferential surface of the photoconductive drum 51.

The image forming unit 5 further includes a transfer roller 55 adjacent to the photoconductive drum 51. The sheet S fed by the registration roller pair 462 is guided by the conveyance path 46, so that the sheet S is fed to a nip between the transfer roller 55 and the photoconductive drum 51. The transfer roller 55 gives, to the sheet S, a bias which has a polarity opposite to that of the toner image on the circumferential surface of the photoconductive drum 51. As a result, the toner image formed on the circumferential surface of the photoconductive drum 51 is transferred onto the sheet S during passage of the sheet between the photoconductive drum 51 and the transfer roller 55. The sheet S with the toner image transferred thereto is, then, fed to the fixing unit 6. The image forming unit 5 further includes a cleaner 56. The cleaner 56 removes toner remaining on the circumferential surface of the photoconductive drum 51 after the transfer process.

The fixing unit 6 includes a heating roller 61, a fixing roller 62, a fixing belt 63 mounted between the heating roller 61 and the fixing roller 62, and a pressure roller 64 pressed in contact with the fixing belt 63/fixing roller 62. An electric heating element such as a halogen lamp is disposed in the heating roller 61. The heating roller 61 supplies thermal energy for melting the toner forming the toner image on the sheet S.

The sheet S fed from the image forming unit 5 is conveyed to a nip between the fixing belt 63/fixing roller 62 and the pressure roller 64. Here, the toner image is fixed onto the sheet S by receiving the thermal energy from the heating roller 61. The sheet S with the toner image fixed in this way is fed to the discharging unit 7.

The discharging unit 7 includes a discharge tray 71 projecting outward from the housing 2 and discharge rollers 72 near a base end of the discharge tray 71. The sheet S with the toner image fixed on one side thereof is discharged onto the discharge tray 71 via the discharge rollers 72.

An image forming apparatus according to one aspect of the above embodiment is configured to form an image on a sheet including a leading edge and a trailing edge opposite to the leading edge. The image forming apparatus includes a housing; a cassette detachably accommodated in the housing and configured to store the sheet; a feeding unit configured to feed the sheet so that the leading edge precedes the trailing edge; and an image forming unit configured to form the image on the sheet fed by the feeding unit, wherein the cassette includes: a first wall along the trailing edge, a second wall along the leading edge, a first bottom plate extending from the first wall toward the second wall, a second bottom plate extending from the second wall toward the first wall, and a connecting member configured to set a first state where the first and second bottom plates are connected and a second state where the first and second bottom plates are disconnected, and the first and second bottom plates in the second state are independently withdrawable from the housing.

According to the above configuration, while the feeding unit feeds a sheet on one of the first and second bottom plates, a user may arrange another sheet on the other bottom plate. An efficient image forming operation may be achieved because the image forming operation is less likely to be interfered with an operation of removing, exchanging or replenishing sheets.

In the above configuration, it is preferable that the sheet includes a first sheet and a second sheet smaller than the first sheet; that the first wall, the second wall and the first and second bottom plates form a first storage space for storing the first sheet when the connecting member sets the first state; and that the connecting member setting the second state partitions the first storage space into a second storage space for storing the second sheet.

According to the above configuration, the cassette may selectively store a larger sheet and a smaller sheet.

In the above configuration, it is preferable that the connecting member includes an intermediate wall rotatably connected with one of the first and second bottom plates; and that the intermediate wall is rotated between a first position where the intermediate wall is disposed along at least one of the first and second bottom plates to form the first storage space in cooperation with the first and second bottom plates and a second position for forming the second storage space.

According to the above configuration, the user is less likely to lose the connecting member. The intermediate wall is rotated between the first position and the second position. The intermediate wall at the first position extends along at least one of the first and second bottom plates to form the first storage space in cooperation with the first and second bottom plates. At this time, the user may withdraw the first and second bottom plates together from the housing because the intermediate wall connects the first and second bottom plates. The intermediate wall at the second position forms the second storage space. At this time, the first and second bottom plates are independently withdrawable from the housing because the intermediate wall disconnects the first and second bottom plates. Accordingly, while the feeding unit feeds the second sheet on one of the first and second bottom plates, another second sheet may be placed on the other bottom plate. An efficient image forming operation may be achieved because the image forming operation is less likely to be interfered with an operation of removing, exchanging or replenishing sheets.

In the above configuration, it is preferable that another of the first and second bottom plates includes a projection to be inserted into a through hole defined in the intermediate wall; and that the projection is inserted in the through hole when the intermediate wall is arranged at the first position.

According to the above configuration, the first and second bottom plates are properly connected with the intermediate wall at the first position.

In the above configuration, it is preferable that the image forming apparatus further includes a sensor configured to detect a position of the intermediate wall and a controller configured to control the feeding unit; and that the controller controls the feeding unit to feed the first sheet when the intermediate wall is arranged at the first position, while controlling the feeding unit to feed the second sheet when the intermediate wall is arranged at the second position.

According to the above configuration, the sheet is appropriately fed according to the position of the intermediate wall.

In the above configuration, it is preferable that the first bottom plate aligned with the second bottom plate in a feeding direction of the sheet is withdrawable in a first direction intersecting with the feeding direction; and that the second bottom plate is withdrawable in a direction along the first direction.

According to the above configuration, the first bottom plate is less likely to interfere with the second bottom plate when the first bottom plate and/or the second bottom plate are/is withdrawn.

In the above configuration, it is preferable that the cassette includes a first peripheral wall standing up from the first bottom plate and a second peripheral wall standing up from the second bottom plate; that the sheet includes a side edge extending between the leading edge and the trailing edge; and that the first and second peripheral walls extend along the side edge.

According to the above configuration, the sheet is properly stored in the cassette because the first and second peripheral walls surround the sheet in cooperation with the first and second walls.

This application is based on Japanese Patent application serial No. 2009-195380 filed in Japan Patent Office on Aug. 26, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus configured to form an image on first sheets of a first size and second sheets of a second size, the first size being larger than the second size, each of the sheets including a leading edge and a trailing edge opposite to the leading edge, the image forming apparatus comprising:

a housing;

a cassette detachably accommodated in the housing and configured to store the sheets;

a feeding unit configured to feed the sheets so that the leading edge precedes the trailing edge; and an image forming unit configured to form the image on the sheets fed by the feeding unit, wherein the cassette includes:

a first wall along the trailing edge, a second wall along the leading edge, a first bottom plate extending from the first wall toward the second wall, a second bottom plate extending from the second wall toward the first wall, and an intermediate wall configured to rotate up and down between a first position in which the intermediate wall connects the first bottom plate with the second bottom plate and a second position in which the intermediate wall disconnects the first bottom plate and the second bottom plate, the first and second bottom plates are independently withdrawable from the housing when the intermediate wall is in the second position, the first wall, the second wall and the first and second bottom plates form a first storage space configured for storing the first sheets when the intermediate wall is in the first position, and the intermediate wall in the second position partitions the first storage space into two second storage spaces, each of which is configured for storing the second sheets, the feeding unit includes a first lift plate and a second lift plate disposed respectively in the two second storage spaces, an elevating mechanism configured to move the first and second lift plates and first and second pick-up rollers corresponding respectively to the two second storage spaces, the elevating mechanism moves one of the first and second lift plates which support the second sheets into a position where the respective first or second pick-up roller draws out from the cassette one of the second sheets when the intermediate wall is in the second position, and the elevating mechanism simultaneously moves both of the first and second lift plates which together support the first sheets when the intermediate wall is in the first position.

2. The image forming apparatus according to claim 1, wherein:

the intermediate wall in the first position is disposed along at least one of the first and second bottom plates.

3. The image forming apparatus according to claim 2, wherein:

one of the first and second bottom plates includes a projection to be inserted into a through hole defined in the intermediate wall when the intermediate wall is at the first position.

4. The image forming apparatus according to claim 2, further comprising:

a sensor configured to detect a position of the intermediate wall; and a controller configured to control the feeding unit;

wherein the controller controls the feeding unit to feed the first sheets when the intermediate wall is arranged at the first position, while controlling the feeding unit to feed the second sheets when the intermediate wall is arranged at the second position.

5. The image forming apparatus according to claim 1, wherein:

the first bottom plate aligned with the second bottom plate in a feeding direction of the sheets is withdrawable in a first direction intersecting with the feeding direction; and the second bottom plate is withdrawable in a direction along the first direction.

6. The image forming apparatus according to claim 1, wherein:

the cassette includes a first peripheral wall standing up from the first bottom plate and a second peripheral wall standing up from the second bottom plate;

the respective sheets includes a side edge extending between the leading edge and the trailing edge; and the first and second peripheral walls extend along the side edge.

7. The image forming apparatus according to claim 2, wherein the intermediate wall is rotatably connected with one of the first and second bottom plates for rotation about an axis that is substantially parallel to the bottom plates and substantially perpendicular to a sheet feeding direction extending from the leading edge to the trailing edge of the respective sheets.

8. The image forming apparatus according to claim 3, wherein the intermediate wall is spaced from the projection when the intermediate wall is in the second position.

9. The image forming apparatus according to claim 7, wherein the first and second bottom plates have inner edges that face each other, and the axis is along one of the inner edges.

10. The image forming apparatus according to claim 9, wherein the intermediate plate is connected with one of the inner edges.

11. An image forming apparatus configured to form an image on first sheets of a first size and second sheets of a second size, the first size being larger than the second size, each of the sheets including a leading edge and a trailing edge opposite to the leading edge, comprising:

a housing;

a cassette detachably accommodated in the housing and configured to store the sheets;

a feeding unit configured to feed the sheets so that the leading edge precedes the trailing edge; and an image forming unit configured to form the image on the sheets fed by the feeding unit, wherein the cassette includes:

a first wall along the trailing edge, a second wall along the leading edge, a first bottom plate extending from the first wall toward the second wall, a second bottom plate extending from the second wall toward the first wall, and an intermediate wall configured to rotate up and down between a first position in which the intermediate wall connects the first bottom plate with the second bottom plate and a second position in which the intermediate wall disconnects the first bottom plate and the second bottom plate, the first and second bottom plates are independently withdrawable from the housing when the intermediate wall is in the second position, the first wall, the second wall and the first and second bottom plates form a first storage space configured for storing the first sheets when the intermediate wall is in the first position, the intermediate wall in the second position partitions the first storage space into two second storage spaces, each of which is configured for storing the second sheets.

12. The image forming apparatus according to claim 11, wherein:

one of the first and second bottom plates includes a projection to be inserted into a through hole defined in the intermediate wall when the intermediate wall is at the first position.

13. The image forming apparatus according to claim 11, further comprising:

a sensor configured to detect a position of the intermediate wall; and a controller configured to control the feeding unit:

wherein the controller controls the feeding unit to feed the first sheets when the intermediate wall is at the first position, while controlling the feeding unit to feed the second sheets when the intermediate wall is at the second position.

14. The image forming apparatus according to claim 11, wherein the intermediate wall is rotatably connected with one of the first and second bottom plates for rotation about an axis that extends substantially parallel to the bottom plates and substantially perpendicular to a sheet feeding direction extending from the leading edge to the trailing edge of the respective sheets.

15. The image forming apparatus according to claim 12, wherein the intermediate wall is spaced from the projection when the intermediate wall is in the second position.

* * * * *